US010186755B2

(12) United States Patent
Xiong et al.

(10) Patent No.: US 10,186,755 B2
(45) Date of Patent: Jan. 22, 2019

(54) ANTENNA MODULE AND MOBILE TERMINAL USING THE SAME

(71) Applicant: Xiaomi Inc., Beijing (CN)

(72) Inventors: Xiaofeng Xiong, Beijing (CN); Linchuan Wang, Beijing (CN); Zonglin Xue, Beijing (CN)

(73) Assignee: Xiaomi Inc., Beijing (CN)

( * ) Notice: Subject to any disclaimer, the term of this patent is extended or adjusted under 35 U.S.C. 154(b) by 221 days.

(21) Appl. No.: 15/018,114

(22) Filed: Feb. 8, 2016

(65) Prior Publication Data

US 2016/0233574 A1 Aug. 11, 2016

(30) Foreign Application Priority Data

Feb. 11, 2015 (CN) ..... 2015 1 0073377

(51) Int. Cl.
*H01Q 1/24* (2006.01)
*H01Q 1/22* (2006.01)
(Continued)

(52) U.S. Cl.
CPC ..... *H01Q 1/243* (2013.01); *H01Q 1/2258* (2013.01); *H01Q 1/2266* (2013.01); *H01Q 1/521* (2013.01); *H01Q 5/50* (2015.01); *H01Q 21/28* (2013.01)

(58) Field of Classification Search
CPC ..... H01Q 1/243; H01Q 1/521; H01Q 1/52; H01Q 21/28; H01Q 5/50; H01Q 1/2258; H01Q 1/2266
See application file for complete search history.

(56) References Cited

U.S. PATENT DOCUMENTS 7,271,769 B2 * 9/2007 Asano ..... G06F 1/1616 343/700 MS
7,623,079 B2 * 11/2009 Hayashi ..... H01Q 1/3291 343/700 MS
(Continued)

FOREIGN PATENT DOCUMENTS

CN 101355196 A 1/2009
CN 102593578 A 7/2012
(Continued)

OTHER PUBLICATIONS

International Search Report of PCT/CN2015/093295, mailed from the State Intellectual Property Office of China dated Feb. 6, 2016.
(Continued)

*Primary Examiner* — Dameon E Levi
*Assistant Examiner* — Ab Salam Alkassim, Jr.
(74) *Attorney, Agent, or Firm* — Finnegan, Henderson, Farabow, Garrett & Dunner LLP

(57) ABSTRACT

An antenna module is provided. The antenna module includes: a first antenna electrically connected to a first section of a metal frame of a mobile terminal, the first antenna comprising a first feed point and a first ground point; and a second antenna electrically connected to a second section of the metal frame of the mobile terminal, the second antenna comprising a second feed point and a second ground point, wherein a slot is formed between the second section of the metal frame and the first section of the metal frame, and the second section of the metal frame is electrically connected to aground point of the mobile terminal via a first contact point.

14 Claims, 7 Drawing Sheets

(51) Int. Cl.

| | |
|---|---|
| ***H01Q 1/52*** | (2006.01) |
| ***H01Q 21/28*** | (2006.01) |
| ***H01Q 5/50*** | (2015.01) |

(56) References Cited

U.S. PATENT DOCUMENTS

| | | | | |
|---|---|---|---|---|
| 8,907,853 | B2 | 12/2014 | Ying | |
| 9,197,270 | B2 * | 11/2015 | Ying | H04B 1/3827 |
| 9,722,300 | B2 * | 8/2017 | Choi | H01Q 1/243 |
| 9,762,710 | B2 * | 9/2017 | Lee | H01Q 1/243 |
| 2004/0257283 | A1 * | 12/2004 | Asano | H01Q 1/243 343/702 |
| 2008/0039043 | A1 * | 2/2008 | Yamazaki | H01Q 1/243 455/269 |
| 2008/0122711 | A1 * | 5/2008 | Kimura | H01Q 1/273 343/745 |
| 2008/0150811 | A1 * | 6/2008 | Honda | H01Q 9/40 343/702 |
| 2008/0170739 | A1 * | 7/2008 | Suematsu | H01Q 1/273 381/380 |
| 2009/0009401 | A1 | 1/2009 | Suzuki et al. | |
| 2009/0027286 | A1 | 1/2009 | Ohishi et al. | |
| 2009/0153407 | A1 * | 6/2009 | Zhang | H01Q 1/243 343/702 |
| 2010/0026596 | A1 | 2/2010 | Nishio et al. | |
| 2010/0053002 | A1 * | 3/2010 | Wojack | H01Q 1/243 343/702 |
| 2010/0149052 | A1 | 6/2010 | Nishio et al. | |
| 2011/0050532 | A1 * | 3/2011 | Liu | H01Q 9/145 343/846 |
| 2011/0063779 | A1 | 3/2011 | Ochi et al. | |
| 2012/0112969 | A1 * | 5/2012 | Caballero | H01Q 1/243 343/702 |
| 2012/0112970 | A1 * | 5/2012 | Caballero | H01Q 1/243 343/702 |
| 2012/0224730 | A1 * | 9/2012 | Kim | H04R 1/1041 381/309 |
| 2012/0229347 | A1 * | 9/2012 | Jin | H01Q 1/243 343/702 |
| 2012/0235866 | A1 * | 9/2012 | Kim | H01Q 1/243 343/700 MS |
| 2012/0262345 | A1 * | 10/2012 | Kim | H01Q 1/243 343/702 |
| 2013/0069836 | A1 * | 3/2013 | Bungo | H01Q 1/243 343/724 |
| 2013/0076580 | A1 | 3/2013 | Zhang et al. | |
| 2013/0093640 | A1 * | 4/2013 | Kwon | H01Q 1/243 343/841 |
| 2013/0135157 | A1 * | 5/2013 | Tsou | H01Q 1/2266 343/702 |
| 2013/0194143 | A1 * | 8/2013 | Bungo | H01Q 21/28 343/725 |
| 2014/0078008 | A1 * | 3/2014 | Kang | H01Q 5/35 343/702 |
| 2014/0113693 | A1 | 4/2014 | Wei et al. | |
| 2014/0139379 | A1 * | 5/2014 | Bolin | H01Q 1/243 343/702 |
| 2014/0266922 | A1 * | 9/2014 | Jin | H01Q 21/28 343/702 |
| 2014/0292589 | A1 | 10/2014 | Park et al. | |
| 2014/0292590 | A1 * | 10/2014 | Yoo | H01Q 1/243 343/702 |
| 2014/0333493 | A1 * | 11/2014 | Yoshino | H01Q 1/084 343/713 |
| 2014/0354487 | A1 | 12/2014 | Liang et al. | |
| 2015/0084817 | A1 * | 3/2015 | Yong | H01Q 1/243 343/702 |
| 2015/0123871 | A1 * | 5/2015 | Chang | H01Q 1/243 343/872 |
| 2015/0145731 | A1 * | 5/2015 | Jhang | H01Q 1/243 343/702 |
| 2016/0020513 | A1 * | 1/2016 | Ohguchi | H01Q 1/243 343/718 |
| 2016/0049720 | A1 * | 2/2016 | Hwang | H01Q 1/243 343/702 |
| 2016/0064812 | A1 * | 3/2016 | Han | H01Q 1/50 343/702 |
| 2016/0064820 | A1 * | 3/2016 | Kim | H01Q 1/243 343/767 |
| 2016/0093955 | A1 * | 3/2016 | Ayala Vazquez | H01Q 9/0442 343/702 |
| 2016/0118710 | A1 * | 4/2016 | Shin | H01Q 1/241 343/702 |
| 2016/0164169 | A1 * | 6/2016 | Krogerus | H01Q 21/28 343/702 |
| 2016/0197403 | A1 * | 7/2016 | Choi | H01Q 1/243 343/700 MS |
| 2016/0197407 | A1 * | 7/2016 | Tanaka | H01Q 1/243 343/845 |
| 2016/0226132 | A1 * | 8/2016 | Kim | H01Q 1/243 |
| 2017/0047638 | A1 * | 2/2017 | Kim | H01Q 1/243 |
| 2017/0047641 | A1 * | 2/2017 | Kim | H01Q 1/243 |
| 2017/0048363 | A1 * | 2/2017 | Lee | H01Q 1/243 |
| 2017/0093022 | A1 * | 3/2017 | Cai | H01Q 1/243 |
| 2017/0170562 | A1 * | 6/2017 | Lee | H01Q 1/243 |
| 2017/0302771 | A1 * | 10/2017 | Kim | H01Q 9/42 |
| 2018/0034135 | A1 * | 2/2018 | Kwak | H01Q 5/35 |
| 2018/0159205 | A1 * | 6/2018 | Wu | H01Q 1/243 |
| 2018/0233807 | A1 * | 8/2018 | Ma | H01Q 1/243 |
| 2018/0261921 | A1 * | 9/2018 | Ha | H01Q 1/24 |

FOREIGN PATENT DOCUMENTS

| | | | |
|---|---|---|---|
| CN | 102696149 | A | 9/2012 |
| CN | 102710817 | A | 10/2012 |
| CN | 102800931 | A | 11/2012 |
| CN | 103022689 | A | 4/2013 |
| CN | 103022704 | A | 4/2013 |
| CN | 103067763 | | 4/2013 |
| CN | 103296385 | | 9/2013 |
| CN | 103326124 | A | 9/2013 |
| CN | 103346397 | A | 10/2013 |
| CN | 103390793 | A | 11/2013 |
| CN | 103606742 | A | 2/2014 |
| CN | 103607484 | A | 2/2014 |
| CN | 203536554 | | 4/2014 |
| CN | 203589193 | U | 5/2014 |
| CN | 104051842 | | 9/2014 |
| CN | 104064866 | | 9/2014 |
| CN | 204144448 | | 2/2015 |
| CN | 104577334 | | 4/2015 |
| EP | 2498336 | A2 | 9/2012 |
| EP | 2709209 | A1 | 3/2014 |
| KR | 20120097877 | A | 9/2012 |

OTHER PUBLICATIONS

Extended European Search Report from European Patent Office for European Application No. 161553441.1, dated Jul. 5, 2016, 8 pages.

English version of International Search Report for International Application No. PCT/CN2015/093295, dated Feb. 6, 2016, 3 pages.

Official Action received from Russian Federation Patent Office for Russian Application No. 2016100189/28, dated Feb. 6, 2017 and English translation thereof, 14 pages.

* cited by examiner

400a

400b

400c

ANTENNA MODULE AND MOBILE TERMINAL USING THE SAME

CROSS-REFERENCE TO RELATED APPLICATION

This application is based upon and claims priority to Chinese Patent Application 201510073377.4, filed Feb. 11, 2015, the entire contents of which are incorporated herein by reference.

TECHNICAL FIELD

The present disclosure generally relates to the field of communication technology and, more particularly to an antenna module and a mobile terminal using the antenna module.

BACKGROUND

With the development of Carrier Aggregation (CA) technology, it is possible to design multiple antennas in a mobile phone, and the multiple antennas may enable the mobile phone to receive different types of wireless signals. In a typical layout of a mobile terminal offering coverage of Long Term Evolution (LTE) frequency band, a LTE Multiple-Input Multiple-Output (MIMO) diversity antenna and a WiFi antenna are generally integrated in the same housing of the mobile terminal. If the spacing distance between the two antennas is relatively small, a serious mutual coupling may occur between the two antennas, which affects the receiving performance of the antennas.

SUMMARY

According to a first aspect of the present disclosure, there is provided an antenna module, comprising: a first antenna electrically connected to a first section of a metal frame of a mobile terminal, the first antenna comprising a first feed point and a first ground point; and a second antenna electrically connected to a second section of the metal frame of the mobile terminal, the second antenna comprising a second feed point and a second ground point, wherein a slot is formed between the second section of the metal frame and the first section of the metal frame, and the second section of the metal frame is electrically connected to a ground point of the mobile terminal via a first contact point.

According to a second aspect of the present disclosure, there is provided a mobile terminal, comprising: an antenna module; and a metal frame. The antenna module comprises: a first antenna electrically connected to a first section of the metal frame, the first antenna comprising a first feed point and a first around point; and a second antenna electrically connected to a second section of the metal frame, the second antenna comprising a second feed point and a second ground point, wherein a slot is formed between the second section of the metal frame and the first section of the metal frame, and the second section of the metal frame is electrically connected to a ground point of the mobile terminal via a first contact point.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

Figure 1:
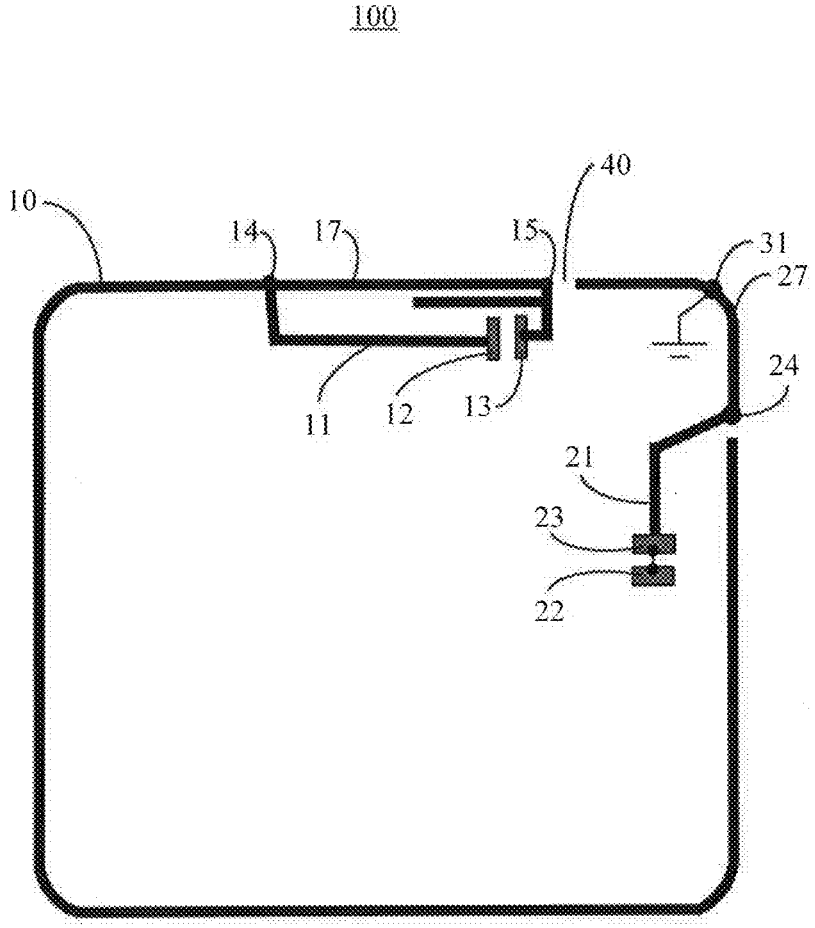
FIG. 1 is a schematic diagram illustrating an antenna module, according to an exemplary embodiment.

FIG. 1 is a schematic diagram illustrating an antenna module 100, according to an exemplary embodiment. The antenna module 100 may be implemented in a mobile terminal 10, such as a smart phone and a tablet device. The mobile terminal 10 may include a metal frame. Referring to FIG. 1, the antenna module 100 includes a first antenna 11 and a second antenna 21. The first antenna 11 includes a first ground point 12 and a first feed point 13, and the second antenna 21 includes a second ground point 22 and a second feed point 23.

As shown in FIG. 1, the first ground point 12 of the first antenna 11 is electrically connected to a first section 17 of the metal frame of the mobile terminal 10, via a connection point 14. The first feed point 13 of the first antenna 11 is electrically connected to the first section 17 of the metal frame via a connection point 15. As shown in FIG. 1, the first feed point 13, the first section 17 of metal frame, and the first ground point 12 form a first loop. The first antenna 11 may radiate radiation energy into free space via the first loop.

The second antenna 21 is electrically connected to a second section 27 of the metal frame of the mobile terminal 10 via a connection point 24. A slot 40 is formed between the second section 27 and the first section 17 of the metal frame. The second section 27 of the metal frame is electrically connected to a ground point of the mobile terminal 10 via a first contact point 31. The second feed point 23 of the second antenna 21 forms a second loop with the second section 27 of the metal frame and the ground point of the mobile terminal 10. The second feed point 23 and the second ground point 22 of the second antenna 21 form a third loop. The second antenna 21 may radiate radiation energy into free space at two separate frequencies via the second and third loops, respectively.

In the present embodiment, the second section 27 of the metal frame is electrically connected to the ground pint of the mobile terminal 10 via the first contact point 31. In doing so, the second section 27 of the metal frame may tune a resonance frequency of the second antenna 21, and may reduce interference to the first antenna 11 by the second antenna 21, thereby enhancing the isolation between the first antenna 11 and the second antenna 21.

In some embodiments, the first contact point 31 may be electrically connected to the ground point of the mobile terminal 10 via a connector of an earphone. The connector of the earphone may be made of a metal material.

In some embodiments, a discharging capacitor may be connected between the first contact point 31 and the connector of the earphone.

In some embodiments, the second section 27 of the metal frame may further be electrically connected with the connector of the earphone via a second contact point, and the second contact point may be provided at an exterior surface of the earphone connector.

In some embodiments, the second section 27 of the metal frame may further be electrically connected with the earphone connector via a third contact point, and the third contact point may be provided at another exterior surface of the earphone connector.

In some embodiments, the ground point of the mobile terminal may be a ground point of a Printed Circuit Board (PCB) in the mobile terminal.

In some embodiments, the first antenna may be a LTE diversity antenna supporting a LTE frequency band, and the second antenna may be a WiFi antenna supporting a WiFi frequency band.

Figure 2:
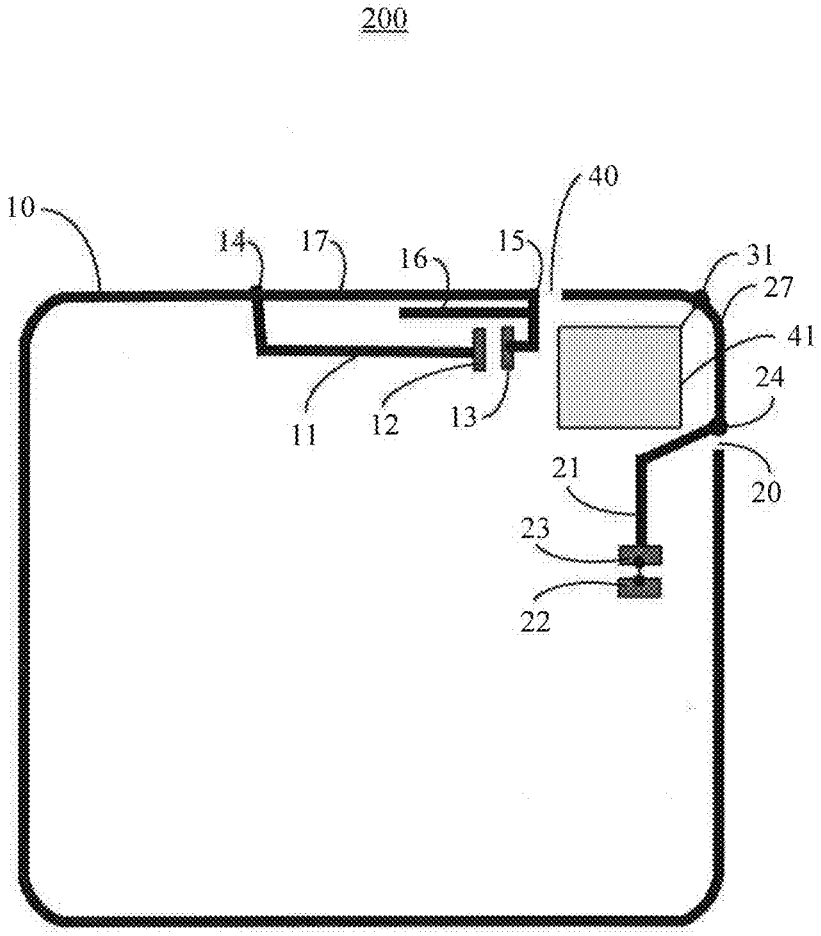
FIG. 2 is a schematic diagram illustrating another antenna module, according to an exemplary embodiment.

FIG. 2 is schematic diagram illustrating an antenna module 200, according to an exemplary embodiment. For example, the first antenna 11 may be a LTE MIMO diversity antenna (hereinafter "diversity antenna"), and the frequency band covered by the diversity antenna is 700 MHz~2700 MHz in the exemplary embodiment. The second antenna 21 may be a WiFi antenna, and the spacing distance between the diversity antenna and the WiFi antenna is approximately the width of the slot 40. For example, the width of the slot 40 may be around 1 mm. The WiFi antenna may be a dual-loop antenna, in which the second feed point 23 may be configured below the second antenna 21, and a metal open ring 20 may be used as a primary radiator. The LTE MIMO diversity antenna may adopt a single loop structure with a parasitic element 16. A person skilled in the art may understand that FIG. 2 is only illustrative and not intended to restrict the present disclosure, and the design of antenna module 200 may be applied to other antennas in the mobile terminal 10.

As shown in FIG. 2, the second section 27 of the metal frame is electrically connected to a ground point of a PCB 41 in the mobile terminal 10 via the first contact point 31. In some embodiments, a discharging capacitor (not shown) may be connected between the first contact point 31 and the PCB 41. In other embodiments, an inductor (not shown) may be connected between the first contact point 31 and the PCB 41. The discharging capacitor and the inductor may tune the second antenna 21 to a specific resonance frequency, and thus the earphone, the PCB 41 and the like, after being integrated in the mobile terminal, may be adaptable to antennas having different resonance frequencies.

Figure 3:
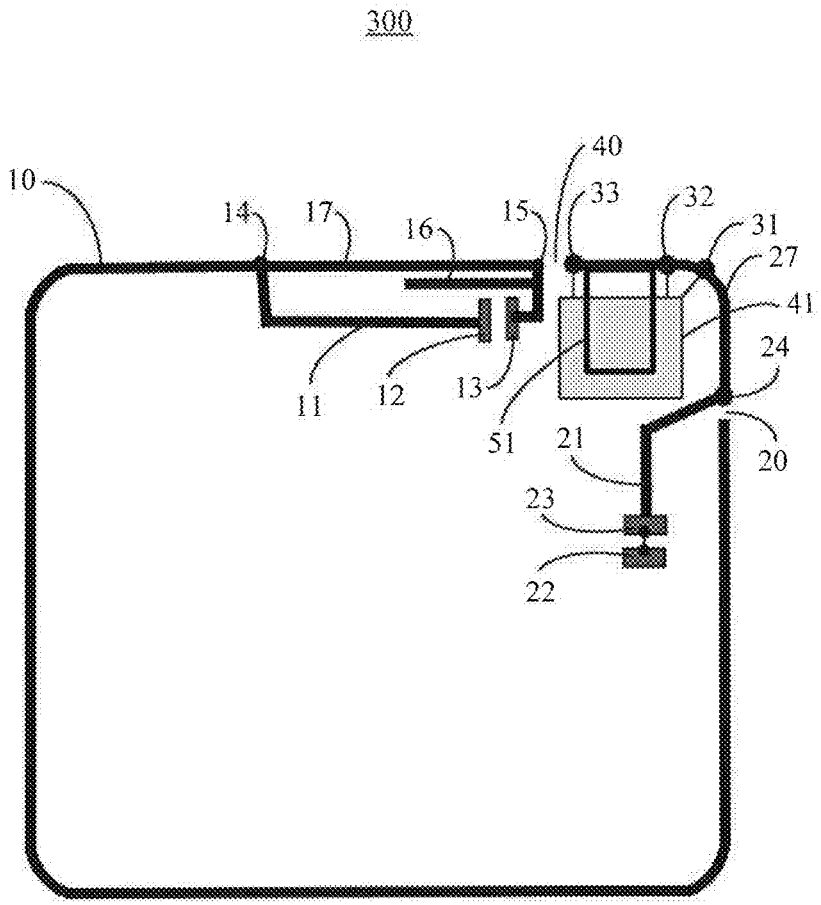
FIG. 3 is a schematic diagram illustrating another antenna module, according to an exemplary embodiment.

FIG. 3 is a schematic diagram illustrating an antenna module 300, according to an exemplary embodiment. In some embodiments, the ground point of the mobile terminal 10 may be a ground point of the PCB 41 in the mobile terminal 10. The second section 27 of the metal frame may be electrically connected to the ground point of the PCB 41 via an earphone connector 51. The earphone connector 51 may be made of a metal material. In some embodiments, the earphone connector 51 may be positioned above an area of the second antenna 21. By designing the earphone connector 51 to be a metal material grounded via the PCB 41, interference to the first antenna 11 and the second antenna 21 by high-order harmonic resonance inside the earphone 51 may be avoided, thereby avoiding undesired frequency shift of the first antenna 11 and the second antenna 21 and improving the antennas performance.

In some embodiments, the second section 27 of metal frame may include a second contact point 32 and a third contact point 33, and both the second contact point 32 and the third contact point 33 are electrically connected to the earphone connector 51. By providing the second touch point 32 on the second section 27 of the metal frame, interference to the first antenna 11 and the second antenna 21 by self-resonance of the earphone connector 51 may be reduced. By providing the third touch point 33 on the second section 27 of the metal frame, the isolation between the first antenna 11 and the second antenna 21 may be further enhanced, and frequency shift of the first antenna 11 and the second antenna 21 may be avoided when the earphone connector 51 is inserted into the mobile terminal 10.

In the antenna module 300, both the second touch point 32 and the third touch point 33 are electrically connected to the earphone connector 51, and the earphone connector 51 is made of a metal material connected to the ground. In doing so, the interference to the first antenna 11 and the second antenna 21 by self-resonance of the earphone connector 51 is reduced, and the isolation between the WiFi antenna and the diversity antenna is enhanced.

Figure 4A:
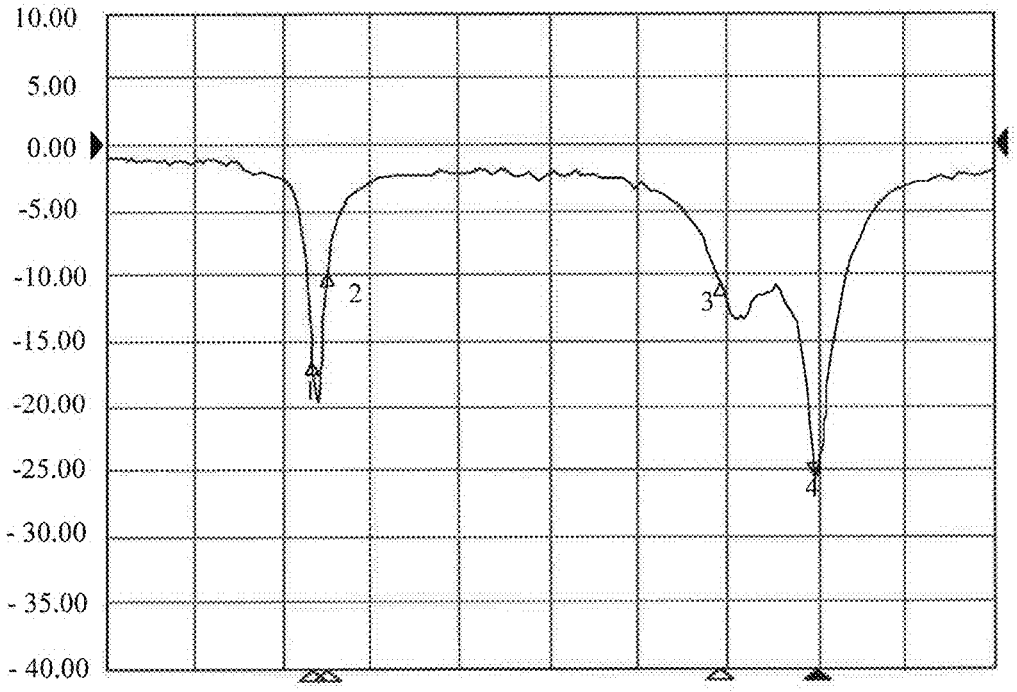
FIG. 4A is a schematic diagram illustrating a test result of a first antenna, according to an exemplary embodiment.

FIG. 4A is a schematic diagram 400*a* illustrating a test result of a first antenna, according to an exemplary embodiment. Referring to FIG. 4A, the horizontal axis represents a frequency, and the vertical axis represents interference induced to the first antenna 11 by the second antenna 21, the unit thereof is decibel (dB). The first antenna is a LTE diversity antenna in this example. When the second antenna operates at a frequency of 2.4 GHZ, the corresponding interference induced to the first antenna is −16.205 dB (as shown at a position in which a symbol "Δ" is labeled as 1). When the second antenna operates at a frequency of 2.5 GHZ, the corresponding interference induced to the first antenna is −9.3160 dB (as shown a Δ2). When the second antenna operates at a frequency of 5.15 GHZ, the corresponding interference induced to the first antenna is −10.371 dB (as shown at Δ3). When the second antenna operates at a frequency of 5.8 GHZ, the corresponding interference induced to the first antenna is −25.938 dB (as shown at Δ4).

The interference to the diversity antenna is relatively small when the WiFi antenna operates at a resonance frequency of about 2.40 Hz (between Δ1 and Δ2), where the interference value is lower than −16 dB. The interference to diversity antenna may also be relative small when the WiFi antenna operates at a resonance frequency of about 5.8 GHz (corresponding to a vicinity of Δ4), where the interference value is lower than a value of −25.938 dB. As such, the antenna module provided in the present disclosure may greatly reduce the interference to the diversity antenna by the WiFi antenna, and as a result, the diversity antenna may radiate more radiation energy to free space via the first loop.

Figure 4B:
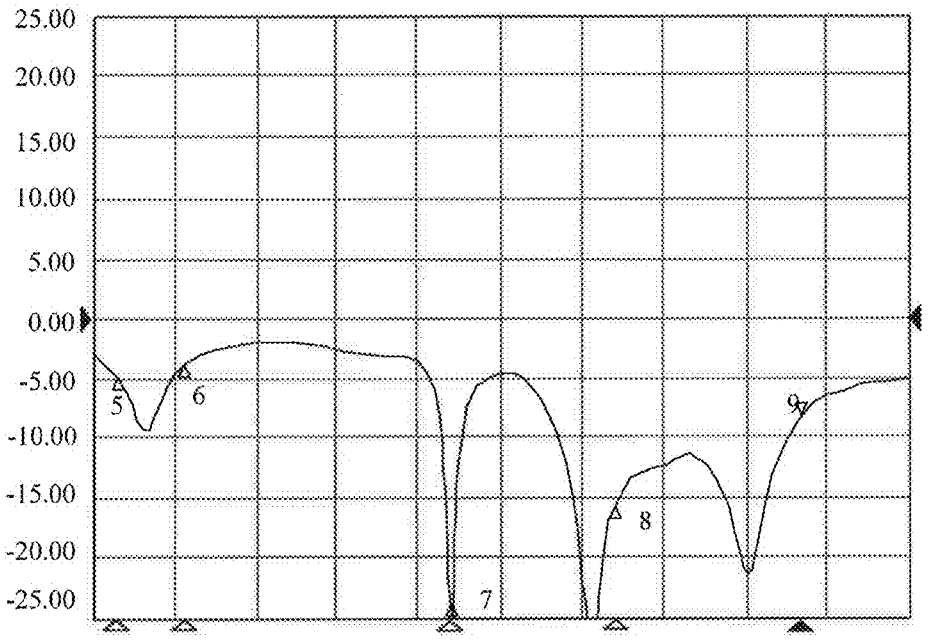
FIG. 4B is a schematic diagram illustrating a test result of a second antenna, according to an exemplary embodiment.

FIG. 4B is a schematic diagram 400*b* illustrating a test result of a second antenna, according to an exemplary embodiment. Referring to FIG. 4B, the horizontal axis represents a frequency, and the vertical axis represents interference induced to the second antenna 21 by the first antenna 11, the unit thereof is decibel (dB). The second antenna 21 is a WiFi antenna in this example. When the first antenna operates at a frequency of 770 MHZ, the corresponding interference induced to the second antenna is −4.7798 dB (as shown at Δ5). When the first antenna operates at a frequency of 960 MHZ, the corresponding interference induced to the second antenna is −3.6482 dB (as shown at Δ6). When the first antenna operates at a frequency of 1.7082 GHZ, the corresponding interference induced to the second antenna is −25.202 dB (as shown at Δ7). When the first antenna operates at a frequency of 2.17 GHZ, the corresponding interference induced to the second antenna is −15.38 dB (as shown at Δ8). When the first antenna operates at a frequency of 2.69 GHZ, the corresponding interference induced to the second antenna is −8.2518 dB (as shown at Δ9).

The WiFi antenna reaches the minimum loss when the diversity antenna operates at a resonance frequency of about 1.7082 GHz where the loss value reaches −25 dB (corresponding to a position of Δ7). The WiFi antenna may also reaches a relative small loss when the diversity antenna operates at a resonance frequency of lower than 2.17 GHz (corresponding to a position of Δ8). As such, the antenna module provided in the present disclosure may greatly reduce the interference to the WiFi antenna by the diversity antenna, and as a result, the WiFi antenna may radiate more radiation energy into free space via the second and third loops.

Figure 4C:
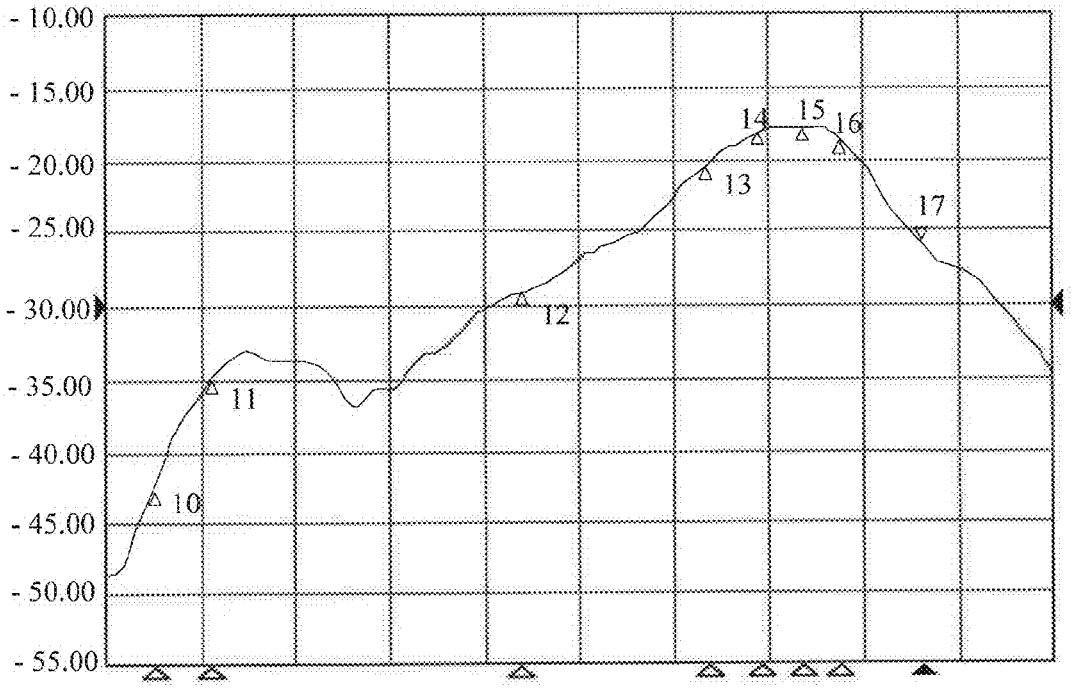
FIG. 4C is a schematic diagram illustrating a test result of an isolation between a first antenna and a second antenna, according to an exemplary embodiment.

FIG. 4C is a schematic diagram 400*c* illustrating a test result of an isolation between the first antenna and the second antenna, according to an exemplary embodiment. Referring to FIG. 4C, the horizontal axis represents a frequency, and the vertical axis represents an isolation between the first antenna 11 and second antenna 21, the unit thereof is decibel (dB). When the first antenna operates at a frequency of 820 MHZ, the corresponding isolation value is −42.355 dB (as shown at Δ10). When the first antenna operates at a frequency of 960 MHZ, the corresponding isolation value is −34.734 dB (as shown at Δ11). When the first antenna operates at a frequency of 1.71 GHZ, the corresponding isolation value is −28.973 dB (as shown at Δ12). When the first antenna operates at a frequency of 2.17 GHZ, the corresponding isolation value is −19.948 dB (as shown at Δ13). When the first antenna operates at a frequency of 2.3 GHZ, the corresponding isolation value is −17.633 dB (as shown at Δ14). When the first antenna operates at a frequency of 2.4 GHZ, the corresponding isolation value is −17.447 dB (as shown at Δ15). When the first antenna operates at a frequency of 2.49 GHZ, the corresponding isolation value is −18.125 dB (as shown at Δ16). When the first antenna operates at a frequency of 2.69 GHZ, the corresponding isolation value is −25.398 dB (as shown at Δ17). The operating frequency of the second antenna is 2.4-2.48 GHZ and 5-5.85 GHZ in this example.

As shown above, within the frequency band of 700 M-2.69 GHz, the isolation between the diversity antenna and the WiFi antenna stays below −1.5 dB. As such, the antenna module provided in the present disclosure may greatly improve the isolation between the first antenna and the second antenna.

Figure 5:
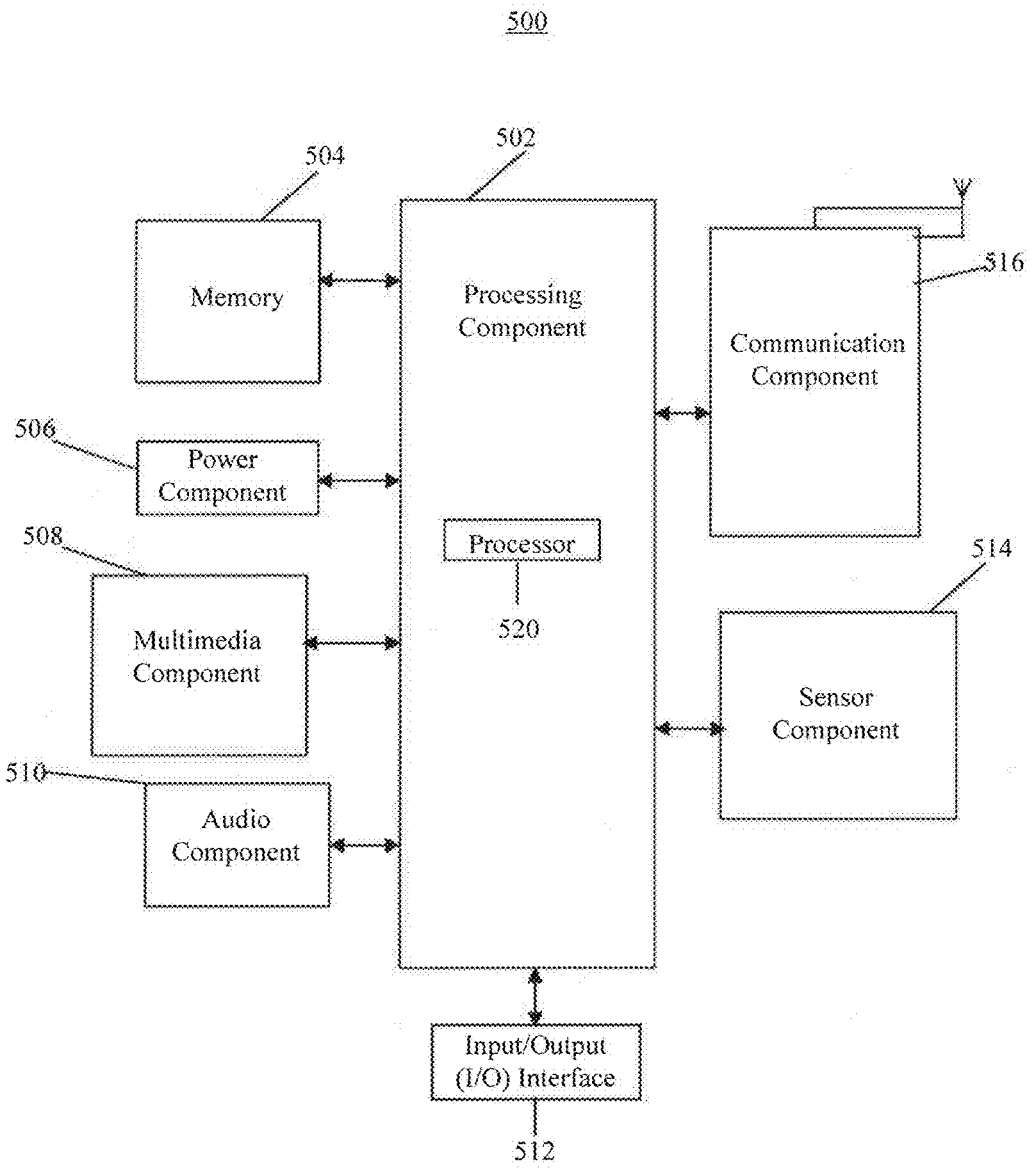
FIG. 5 is a block diagram illustrating a mobile terminal, according to an exemplary embodiment.

FIG. 5 is a block diagram illustrating a mobile terminal 500, according to an exemplary embodiment. The mobile terminal 500 may include the antenna module described above. For example, the mobile terminal 500 may be a mobile phone, a computer, a digital broadcast terminal a messaging device, a gaming console, a tablet device, a medical device, exercise equipment, a personal digital assistant (PDA), and the like.

Referring to FIG. 5, the mobile terminal 500 may include one or more of the following components: a processing component 502, a memory 504, a power component 506, a multimedia component 508, an audio component 510, an input/output (I/O) interface 512, a sensor component 514, and a communication component 516. The person skilled in the art should appreciate that the structure of the mobile terminal 500 as shown in FIG. 5 does not intend to limit the mobile terminal 500. The mobile terminal 500 may include more or less components or combine some components or other different components.

The processing component 502 typically controls overall operations of the mobile terminal 500, such as the operations associated with display, telephone calls, data communications, camera operations, and recording operations. The processing component 502 may include one or more processors 520 to execute instructions to perform various methods. Moreover, the processing component 502 may include one or more modules which facilitate the interaction between the processing component 502 and other components. For instance, the processing component 502 may include a multimedia module to facilitate the interaction between the multimedia component 508 and the processing component 502.

The memory 504 is configured to store various types of data to support the operation of the mobile terminal 500. Examples of such data include instructions for any applications or methods operated on the mobile terminal 500, contact data, phonebook data, messages, images, video, etc. The memory 504 is also configured to store programs and modules. The processing component 502 performs various functions and data processing by operating programs and modules stored in the memory 504. The memory 504 may be implemented using any type of volatile or non-volatile memory mobile terminals, or a combination thereof, such as a static random access memory (SRAM), an electrically erasable programmable read-only memory (EEPROM), an erasable programmable read-only memory (EPROM), a programmable read-only memory (PROM), a read-only memory (ROM), a magnetic memory, a flash memory, a magnetic or optical disk.

The power supply component 506 is configured to provide power to various components of the mobile terminal 500. The power supply component 506 may include a power management system, one or more power sources, and any other components associated with the generation, management, and distribution of power in the mobile terminal 500.

The multimedia component 508 includes a screen providing an output interface between the mobile terminal 500 and a user. In some embodiments, the screen may include a liquid crystal display (LCD) and/or a ouch panel (TP). If the screen includes the touch panel, the screen may be implemented as a touch screen to receive input signals from the user. The touch panel includes one or more touch sensors to sense touches, swipes, and gestures on the touch panel. The touch sensors may not only sense a boundary of a touch or swipe action, but also sense a period of time and a pressure associated with the touch or swipe action. In some embodiments, the multimedia component 508 includes a front camera and/or a rear camera. The front camera and the rear camera may receive an external multimedia datum while the mobile terminal 500 is in an operation mode, such as a photographing mode or a video mode. Each of the front camera and the rear camera may be a fixed optical lens system or have focus and optical zoom capability.

The audio component 510 is configured to output and/or input audio signals. For example, the audio component 510 includes a microphone configured to receive an external audio signal when the mobile terminal 500 is in an operation mode, such as a call mode, a recording mode, and a voice recognition mode. The received audio signal may be further stored in the memory 504 or transmitted via the communication component 516. In some embodiments, the audio component 510 further includes a speaker to output audio signals.

The I/O interface 512 provides an interface between the processing component 502 and peripheral interface modules, such as a keyboard, a click wheel, buttons, and the like. The buttons may include, but are not limited to, a home button, a volume button, a starting button, and a locking button.

The sensor component 514 includes one or more sensors to provide status assessments of various aspects of the mobile terminal 500. For instance, the sensor component 514 may detect an on/off state of the mobile terminal 500, relative positioning of components, e.g., the display and the keypad, of the mobile terminal 500, a change in position of the mobile terminal 500 or a component of the mobile terminal 500, a presence or absence of user contact with the mobile terminal 500, an orientation or an acceleration/deceleration of the mobile terminal 500, and a change in temperature of the mobile terminal 500. The sensor component 514 may include a proximity sensor configured to detect the presence of nearby objects without any physical contact. The sensor component 514 may also include a light sensor, such as a CMOS or CCD image sensor, for use in imaging applications. In some embodiments, the sensor component 514 may also include an accelerometer sensor, a gyroscope sensor, a magnetic sensor, a pressure sensor, or a temperature sensor.

The communication component 516 is configured to facilitate communication, wired or wirelessly, between the mobile terminal 500 and other devices. The mobile terminal 500 can access a wireless network based on a communication standard, such as WiFi, 2G, or 3G, LTE, or a combination thereof. For example, the communication component 516 may include the antenna module 100, 200, or 300 described above. In one exemplary embodiment, the communication component 516 receives a broadcast signal or broadcast information from an external broadcast management system via a broadcast channel. In one exemplary embodiment, the communication component 516 further includes a near field communication (NFC) module to facilitate short-range communications. For example, the NFC module may be implemented based on a radio frequency identification (RFID) technology, an infrared data association (IrDA) technology, ultra-wideband (UWB) technology, a Bluetooth (BT) technology, and other technologies.

In exemplary embodiments, the mobile terminal 500 may be implemented with one or more application specific integrated circuits (ASICs), digital signal processors (DSPs), digital signal processing devices (DSPDs), programmable logic devices (PLDs), field programmable gate arrays (FPGAs), controllers, micro-controllers, microprocessors, or other electronic components, for performing the above described methods.

Other embodiments of the invention be apparent to those skilled in the art from consideration of the specification and practice of the invention disclosed here. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. An antenna module, comprising:

a first antenna electrically connected to a first section of a metal frame of a mobile terminal, the first antenna comprising a first feed point and a first ground point, wherein the first antenna includes a single loop structure with a parasitic element; and a second antenna electrically connected to a second section of the metal frame of the mobile terminal, the second antenna comprising a second feed point and a second ground point, wherein the second antenna includes a dual-loop antenna with a metal open ring, wherein a slot is formed between the second section of the metal frame and the first section of the metal frame, and the second section of the metal frame is electrically connected to a ground point of the mobile terminal via a first contact point, wherein the first contact point is electrically connected to the ground point of the mobile terminal via a connector of an earphone, and wherein the second section of metal frame is electrically connected with the connector of the earphone via a second contact point and a third contact point, the second contact point is at an exterior surface of the connector of the earphone, and the third contact point is at another exterior surface of the connector of the earphone.

2. The antenna module of claim 1, further comprising a discharging capacitor connected between the first contact point and the connector of the earphone.

3. The antenna module of claim 1, wherein the connector of the earphone is made of a metal material.

4. The antenna module of claim 1, wherein the ground point of the mobile terminal is a ground point of a Printed Circuit Board (PCB) in the mobile terminal.

5. The antenna module of claim 1, wherein the first antenna is a Long Term Evolution (LTE) antenna, and the second antenna is a WiFi antenna.

6. The antenna module of claim 1, wherein the first antenna operates at a first frequency band, and the second antenna operates at a second frequency band.

7. The antenna module of claim 1, wherein the first ground point of the first antenna is electrically connected to the first section of the metal frame via a first connection point, the first feed point of the first antenna is electrically connected to the first section of the metal frame via a second connection point, and the second antenna is electrically connected to the second section of the metal frame via a third connection point.

8. A mobile terminal, comprising:

an antenna module; and a metal frame;

wherein the antenna module comprises:

a first antenna electrically connected to a first section of the metal frame, the first antenna comprising a first feed point and a first ground point, wherein the first antenna includes a single loop structure with a parasitic element; and a second antenna electrically connected to a second section of the metal frame, the second antenna comprising a second feed point and a second ground point, wherein the second antenna includes a dual-loop antenna with a metal open ring, wherein a slot is formed between the second section of the metal frame and the first section of the metal frame, and the second section of the metal frame is electrically connected to a ground point of the mobile terminal via a first contact point, wherein the first contact point is electrically connected to the ground point of the mobile terminal via a connector of an earphone, and wherein the second section of metal frame is electrically connected with the connector of the earphone via a second contact point and a third contact point, the second contact point is at an exterior surface of the connector of the earphone, and the third contact point is at another exterior surface of the connector of the earphone.

9. The mobile terminal of claim 8, wherein the antenna module further comprises a discharging capacitor connected between the first contact point and the connector of the earphone.

10. The mobile terminal of claim 8, wherein the connector of the earphone is made of a metal material.

11. The mobile terminal of claim 8, further comprising a Printed Circuit Board (PCB), wherein the ground point of the mobile terminal is a ground point of the PCB.

12. The mobile terminal of claim 8, wherein the first antenna is a Long Term Evolution (LTE) antenna, and the second antenna is a WiFi antenna.

13. The mobile terminal of claim 8, wherein the first antenna operates at a first frequency band, and the second antenna operates at a second frequency band.

14. The mobile terminal of claim 8, wherein the first ground point of the first antenna is electrically connected to the first section of the metal frame via a first connection point, the first feed point of the first antenna is electrically connected to the first section of the metal frame via a second connection point, and the second antenna is electrically connected to the second section of the metal frame via a third connection point.

* * * * *